US011401707B2

(12) United States Patent
Zhou

(10) Patent No.: US 11,401,707 B2
(45) Date of Patent: Aug. 2, 2022

(54) PREFABRICATED WALL AND ASSEMBLY STRUCTURE FOR PREFABRICATED BUILDING, AND CONSTRUCTION METHOD THEREFOR

(71) Applicant: Zhaodi Zhou, Zhejiang (CN)

(72) Inventor: Zhaodi Zhou, Zhejiang (CN)

( * ) Notice: Subject to any disclaimer, the term of this patent is extended or adjusted under 35 U.S.C. 154(b) by 0 days.

(21) Appl. No.: 17/259,069

(22) PCT Filed: Jul. 10, 2019

(86) PCT No.: PCT/CN2019/095384
§ 371 (c)(1),
(2) Date: Jan. 8, 2021

(87) PCT Pub. No.: WO2020/011186
PCT Pub. Date: Jan. 16, 2020

(65) Prior Publication Data

US 2021/0277651 A1 Sep. 9, 2021

(30) Foreign Application Priority Data

Jul. 10, 2018 (CN) ..... 201810753058.1

(51) Int. Cl.
*E04B 1/41* (2006.01)
*E04B 2/56* (2006.01)

(52) U.S. Cl.
CPC ..... *E04B 1/4142* (2013.01); *E04B 1/4157* (2013.01); *E04B 2/562* (2013.01); *E04B 2103/02* (2013.01)

(58) Field of Classification Search
USPC ..... 52/236.3, 236.5, 236.8, 252, 249, 260, 52/741.14
See application file for complete search history.

(56) References Cited

U.S. PATENT DOCUMENTS 3,295,286 A * 1/1967 Schaich ..... E04B 1/06 52/583.1
3,369,334 A * 2/1968 Berg ..... E04C 5/165 52/223.13

(Continued)

FOREIGN PATENT DOCUMENTS

CM 202809892 U 3/2013
CN 204940608 U 1/2016

(Continued)

OTHER PUBLICATIONS

Patent Cooperation Treaty: International Search Report and Written Opinion for PCT/CN2019/095384 dated Aug. 28, 2019; 12 pages, including English translation.

(Continued)

*Primary Examiner* — Joshua K Ihezie
(74) *Attorney, Agent, or Firm* — Schwabe, Williamson & Wyatt, PC

(57) ABSTRACT

A prefabricated wall for a prefabricated building includes a concrete body and a rigid framework arranged inside the poured concrete body, the rigid framework comprises n longitudinally extending vertical rebars, with n being an integer greater than or equal to three; an upper end face and a lower end face of the prefabricated wall are formed with m mechanical connection portions at positions sharing the same axes as the vertical rebars, with m being an integer less than or equal to 2n; and the mechanical connection portions are all formed at end portions of the vertical rebars. An assembly structure for a prefabricated building is further provided. The assembly structure is formed by filling an assembly gap with an on-site poured layer after rebars are firmly connected at an overhead region between an upper-layer wall, a lower-layer wall and a floor slab by means of fastening components.

6 Claims, 18 Drawing Sheets

(56) References Cited

U.S. PATENT DOCUMENTS

| | | | | |
|---|---|---|---|---|
| 5,134,828 | A * | 8/1992 | Baur | E04B 1/043 52/699 |
| 6,058,672 | A * | 5/2000 | McClellan | E04B 1/04 52/309.12 |
| 7,134,805 | B2 * | 11/2006 | Yee | F16L 13/113 404/50 |
| 8,490,363 | B2 * | 7/2013 | Nagy | E04B 1/04 52/745.05 |
| 9,523,201 | B2 * | 12/2016 | Romanenko | E04C 1/397 |
| 10,094,101 | B1 * | 10/2018 | Jazzar | E04B 5/32 |
| 10,260,224 | B1 * | 4/2019 | Jazzar | E04B 1/164 |
| 2009/0094915 | A1 * | 4/2009 | Liberman | E04B 1/215 52/293.3 |
| 2009/0139177 | A1 * | 6/2009 | Holdsworth | E04C 5/165 52/713 |
| 2014/0013699 | A1 | 1/2014 | Gallinat | |
| 2018/0209134 | A1 * | 7/2018 | Calderon Uriszar-Aldaca | E04B 1/043 |

FOREIGN PATENT DOCUMENTS

| | | | | |
|---|---|---|---|---|
| CN | 206722139 | U | 2/2018 | |
| CN | 207003837 | U | 2/2018 | |
| CN | 108222280 | A | 6/2018 | |
| DE | 19525082 | A1 * | 1/1997 | B28B 23/0025 |
| JP | H1162920 | A | 3/1999 | |
| JP | 2001055812 | A | 2/2001 | |
| JP | 2005016157 | A | 1/2005 | |
| JP | 2006045871 | A | 2/2006 | |
| JP | 2009144400 | A | 7/2009 | |
| JP | 2014148849 | A | 8/2014 | |
| JP | 2016065397 | A | 4/2016 | |
| JP | 2016132910 | A | 7/2016 | |

OTHER PUBLICATIONS

Extended European Search Report in Application No. 19835153.8 dated Mar. 22, 2022; 8 pages.

Notice of Reasons for Refusal in JP Application No. 2021-524091 dated Jan. 7, 2022; 12 pages.

Final Notification of Reasons for Refusal: JP Application No. 2021-524091 dated Apr. 14, 2022; 10 pages, including English translation.

* cited by examiner

PREFABRICATED WALL AND ASSEMBLY STRUCTURE FOR PREFABRICATED BUILDING, AND CONSTRUCTION METHOD THEREFOR

CROSS-REFERENCE TO RELATED APPLICATION

The present application is a National Phase entry of PCT Application No. PCT/CN2019/095384, filed on Jul. 10, 2019, which claims priority to Chinese Patent Applications No. 201810753058.1, titled "PREFABRICATED WALL AND ASSEMBLY STRUCTURE FOR ASSEMBLY BUILDING, AND CONSTRUCTION METHOD THEREFOR", filed with the China National Intellectual Property Administration on Jul. 10, 2018, the entire disclosures of which are incorporated herein by reference.

FIELD

The present application relates to the technical field of building structures, and in particular to a prefabricated wall and an assembly structure for an assembly building, and a construction method thereof.

BACKGROUND

At present, with vigorous implementation of housing industrialization in China, a number of assembly housing projects have been carried out in many places. Most of the existing prefabricated building technologies are imported from abroad, and the technologies of "sleeve mortar anchor connection" and "reserved hole indirect lap mortar anchor connection", which are widely used in many countries such as the United States and Japan, are adopted. A common point of "sleeve mortar anchor connection" and "reserved hole indirect lap mortar anchor connection" technology is to embed a grouting sleeve in the concrete. After the concrete reaches the required strength, the steel bar penetrates into the grouting sleeve, and then the high-strength non-shrinkage grouting is poured into the grouting sleeve for maintenance, so as to anchor the steel bar. Referring to FIG. 1, the steel bar sleeve grouting technology makes buildings be able to be assembled, which has been approved by engineering users.

Limited by the construction or structure required by the above two connection methods, however, there are following shortcomings in the two connection methods.

First, the force transmission manners of the steel bars between the walls of the above two connection methods is indirect force transmission, which needs to be transmitted through the grouting in the reserved holes, and the force transmission is not direct. Under normal force, two steel bars that are far apart need to transmit force to each other. This force transmission manner may generate additional bending moment and shear force on the surrounding concrete, making the force of the wall complicated here. Meanwhile, when the axial pressure is relatively high, local pressure cracks on the top of the grouting may occur. Moreover, the two connection methods have high requirements for grouting and grouting technology. If there are bubbles or other uncompacted factors in the grouting sleeve, it may have a great impact on this connection manner.

Secondly, in this connection manner, the grouting sleeve is hidden inside the wall. If the grouting is not dense in the construction process, or the grouting length is insufficient due to slight leakage afterwards, it is difficult to be checked by the construction personnel or quality inspection personnel, and there is a hidden danger that the assembly quality may not be guaranteed.

Thirdly, in order to meet the requirements of grouting technology, grouting holes and air outlets protruding from the grouting sleeve need to be left on the grouting sleeve. In the wall with more longitudinal steel bars, the grouting holes and air holes may occupy a large volume at the bottom of the wall. In practical engineering, the bottom area of the wall is often stressed greatly, which is the part that contributes greatly to the ductility of the wall. However, with the above arrangement, the bottom area of the wall becomes a relatively weak part of the wall. In practice, cracks often spread around from grouting holes or air outlets, and there is a phenomenon that concrete falls off as a whole here. In addition, the outer diameter of the grouting sleeve is large, ranging from 4-5 cm, and the outer surface of the grouting sleeve is generally smooth at present, which may not form an effective constraint with the surrounding concrete. Therefore, in the later stage of the project, large concrete blocks at the bottom often fall out and the effective compression area at the bottom decreases, so the assembly structure itself may affect the bearing capacity of the wall in the later stage and reduce the ductility of the wall.

Based on the above, the field of prefabricated buildings urgently needs a prefabricated wall with direct force transmission and stable structure, as well as an assembly structure and construction method with controllable assembly quality and little impact on the wall.

SUMMARY

On the basis of the prior art, one of the aims of the present application is to provide an assembled prefabricated wall with a simple wall skeleton and no need of adding embedded parts, in order to solve the technical problem that the structural parts of the foot part of the prefabricated wall are numerous and complex, which seriously affects the bearing capacity of the wall.

In order to achieve the above objectives, the technical solution adopted by the present application is as follows;

an assembled prefabricated wall, including a concrete main body and a rigid framework poured in the concrete main body, in which the rigid framework includes n vertical ribs extending longitudinally, and n is an integer greater than or equal to 3, and, an upper end face and a lower end face of the prefabricated wall are formed with m mechanical connecting parts at the same axis position of the vertical ribs, and m is an integer less than or equal to 2n, and the mechanical connecting parts are all formed at end heads of the vertical ribs, and the purpose of this arrangement is: because the present application designs the mechanical connecting parts at ends of the vertical ribs, on one hand, the embedded parts at the foot of the prefabricated wall are completely removed, which greatly simplifies the structure of the internal framework of the prefabricated wall and is beneficial to the positioning and fixing of the skeleton during the prefabrication of the wall, and effectively avoids the problem of dislocation and displacement of mechanical connecting parts during pouring, and further facilitates the stability of vibrating compaction, on the other hand, the mechanical connecting parts are designed at the ends of the vertical ribs, which is beneficial to the direct transmission of force after connection, in addition, the connection parts are exposed outside the concrete main body, which makes the connection firmness visible and controllable, and effectively ensures the connection quality.

Each of the mechanical connecting parts includes a bearing and connecting end and/or a bearing and connecting cavity, which is arranged on the upper end face and/or the lower end face of the prefabricated wall body. The end head of the vertical rib protrudes from the surface of the concrete main body, and the bearing and connecting part formed at the end head of the vertical rib is the bearing and connecting end; the end head of the vertical rib forms an open bearing and connecting part recessed inward along the axial direction of the vertical rib as a bearing and connecting cavity. The purpose of this arrangement is: on one hand, the mechanical connecting part may extend out of the concrete main body, and the mechanical connecting part is no longer embedded in the concrete main body, so that the connection is visualized, which is convenient to check and intuitively understand the firmness of the connection and ensure the connection quality; on the other hand, the wall structure of the sleeve embedded in the concrete main body in the prior art is changed. The mechanical connecting part does not need to be provided with grouting holes and air outlets, so as to overcome the technical problem that the ductility of the wall is reduced due to the fact that the foot parts of the wall are numerous and complex in the prior art.

An outer diameter of the bearing and connecting end is 0.7~2 times the outer diameter of the vertical rib, and the outer diameter of the bearing and connecting cavity is 1.2~3 times the outer diameter of the vertical rib. The purpose of this arrangement is: compared with the existing sleeve, the volume of the mechanical connecting part is greatly shortened and reduced, so as to overcome the problem that the grouting hole and the air outlet of the sleeve in the sleeve connection or lap joint occupy too much volume at the bottom in the prior art, which makes the bottom area of the wall become a relatively weak part of the wall, and avoids the phenomenon that spreading cracks are formed due to the relatively weak surrounding grouting holes or vent holes when the force is applied, and the phenomenon of concrete falling off in a whole piece here.

An external thread is provided on the bearing and connecting end, an internal thread is provided on the bearing and connecting cavity. The purpose of this arrangement is: multiple components are connected through threads, which is convenient for processing and mounting mechanical connecting parts and other components; and the threaded connection is clear in force transmission, reliable in connection and convenient to mount, and may obviously improve the construction speed.

The bearing and connecting cavity is formed based on a sleeve rigidly connected to the end head of the vertical rib, and the end of the sleeve far away from the vertical rib forms the open bearing and connecting cavity. The purpose of this arrangement is: since the bearing and connecting cavity is formed by combining the vertical rib and the sleeve connected to the end of the vertical rib, the machining cost is lower than that of the vertical ribs integrally forming the bearing and connecting cavity, and it is also convenient to rotate the bearing and connecting cavity when the skeleton is fixed in the wall prefabrication process, because the vertical rib and the sleeve are relatively independent, the sleeve may be rotated independently, which is beneficial to the positioning and fixing of the vertical rib and the sleeve in the mold.

The assembled prefabricated wall may include not only a flat wall, but also a special-shaped wall such as an L-shaped wall, a rectangular wall, a U-shaped wall, an arc-shaped wall, and etc. When the prefabricated wall is of a special-shaped structure, adjacent walls between prefabricated walls are $\angle\alpha$ in the horizontal direction, and 0 degree$<\alpha<$360 degrees. The forming of the special-shaped prefabricated wall may be a fixed splicing connection of multiple walls or integral forming. The purpose of this arrangement is: when a single prefabricated wall may not meet the needs of the building, it is necessary to combine or deform the prefabricated wall to form the above-mentioned prefabricated wall into a non-linear integral wall in the horizontal direction. Then a structure similar to the above vertical rib and mechanical connecting part of the wall is formed in the longitudinal direction of the prefabricated wall. In this way, it greatly simplifies the structure of embedded parts in prefabricated wall and rigid skeleton in prefabricated wall, and provides great convenience and practical basis for prefabricating complex wall in mold. At the same time, it further provides great convenience for the longitudinal connection between the walls.

Another object of the present application is to provide a connection manner or assembly structure of prefabricated members which is convenient for assembly and directly transmits force and a construction method thereof, aiming at the technical problems of indirect force transmission, high sealing requirements and difficult connection quality assurance in the existing connection manner of prefabricated walls.

An assembly structure of a prefabricated building including the above prefabricated wall, including an upper wall, a lower wall, and fastening components, in which the upper wall and the lower wall are the above prefabricated walls; and the upper wall is located above the lower wall, and the vertical ribs in the upper wall are mechanically connected to the vertical ribs in the lower wall by fastening components.

The assembly structure further includes a concrete cast-in-place area between the upper wall and the lower wall, and the concrete cast-in-place area covers the fastening component.

The fastening component includes a plug rod, a locking piece, a buckle barrel and an adapter sleeve. The mechanical connecting parts of the upper wall or the lower wall are respectively connected to the adapter sleeve and the plug rod correspondingly. The buckle barrel is fixed in the adapter sleeve, the plug rod is inserted into the buckle barrel, and the locking piece is sleeved on an outer edge of the plug rod, so that the plug rod is clamped with the buckle barrel without gap. In this way, of the upper wall and the lower wall are firmly connected in the cast-in-place area in the longitudinal direction, this connection structure makes the connected part no longer be concealed in the wall, and it may be clearly observed whether the connection is in place, so as to ensure the stability of the wall connection and the controllability of the assembly quality. In addition, this connection structure directly connects the wall or the longitudinal (vertical) ribs in the wall, the force transmission is more direct, and through ribs are formed in the wall connection structure, which improves the overall ductility of the wall and the building formed by the wall.

Further, the assembly structure further includes a prefabricated floor slab and a cast-in-place layer. The lower edge of the prefabricated floor slab is laid on every adjacent lower wall, and the cast-in-place layer fills the assembly gap among the prefabricated floor slab, the upper wall and the lower wall. In addition, in the vertical direction, the height of the cast-in-place layer is at least flush with the upper prefabricated wall or the lower end face of the wall. Since the mechanical connecting part between the walls is arranged outside the prefabricated wall in the technical solution of the present application, it is necessary to fill or pad the overhead part with a cast-in-place layer when forming a whole building. The cast-in-place layer pads the assembly gap well. Due to the fluidity of the cast-in-place concrete, it may fully and effectively fill all the assembly gaps at one time, which further ensures the integrity of the assembled connection structure, ensures that the connection structure has no gaps and is integrated, and further improves its stability.

Further, the assembly gap filled by the cast-in-place layer includes the overhead area between the lower end face of the upper wall and the upper end face of the lower wall, and the space between an upper face of the prefabricated floor slab and the lower end face of the upper wall. Because the forming of cast-in-place layer takes a certain amount of time, it is convenient to add other attachments, such as floor tiles, floor keels and patch panels, to the cast-in-place layer on the prefabricated floor slab during the forming process.

Further, a rigid truss is exposed on the upper surface of prefabricated floor slab, and the cast-in-place layer is filled with the rigid truss. The rigid truss is exposed on the prefabricated floor slab, and then covered and filled with the cast-in-place layer, which is convenient for fixing the embedded objects in the prefabricated floor slab and further constructing the internal structure of the prefabricated floor slab. The embedded objects of prefabricated floor slab are fixed on the rigid truss or laid on the prefabricated floor slab or inserted in the gap of the rigid truss. After the cast-in-place layer is filled, these embedded objects are fixed in the floor. The embedded objects include the horizontal or longitudinal ribs of the prefabricated floor slab, electric wire pipes, air-conditioning pipes, floor heating pipes, water pipes, etc.

A construction method of the prefabricated building, including the following steps: step for fixing a lower wall: fixing the lower wall on a foundation or platform or on a floor that has been assembled:

- step for setting support: according to the design requirements, assembling a support frame to support a prefabricated floor slab around the lower wall;
- step for laying the prefabricated floor slab: laying the prefabricated floor slab on the support frame, and overlapping an end of the prefabricated floor slab with the top of the lower wall;
- step for connecting wall: hoisting the upper wall to a designated position, so that the vertical ribs of the upper wall and the vertical ribs of the lower wall are mechanically connected by a fastening component;
- step for adjusting the fastening component: adjusting the fastening component to meet the pull-out and tensile requirements for the connection and fixation of the upper wall and the lower wall;
- step for cast-in-place: pouring concrete filler into the prefabricated floor slab and an assembly gap between the upper wall and the lower wall to form a cast-in-place layer, so that the floor, the upper wall and the lower wall form an integral structure without gaps: repeating the step for setting support to the step for cast-in-place until the construction of the prefabricated building is completed.

In the step for setting support, the supporting bracket is assembled and fixed flush with the upper end face of the lower wall, so that the support frame supports the prefabricated floor slab in the horizontal direction, thus avoiding the accident that the prefabricated floor slab falls.

Further, in the step for connecting wall, it further includes adjustment and positioning, namely, setting adjustment pads between the upper wall and the lower wall, and setting diagonal braces between the prefabricated floor slab and the upper wall. In this way, when the wall is connected, the level and height of the long side of the wall may be adjusted by adjusting the number of pads, and the level and inclination of the vertical and short sides of the wall may be adjusted by diagonal bracing, which may not only do not need the spreader but also further realize accurate connection and improve connection accuracy.

Compared with the prior art, the present application has the following characteristics and beneficial effects.

The present application adopts a connection method in which a fastening component and a mechanical connecting part directly butt the vertical ribs, which may quickly mount and position the assembled wall, increase the connection stiffness of the node, and realize the design principle of strong nodes and weak components. This kind of node structure has good seismic performance, and at the same time ensures good stability of the wall connection. The design of the prefabricated wall considers the integrity of the wall's force, and uses vertical ribs to strengthen the strength of part of the concrete wall, improve the ductility at the foot of the wall, strengthen the overall stability of the components, and ensure the safety and reliability of the wall. After the vertical ribs are connected with each other, through ribs are formed in the assembled connection structure, which better ensures the integrity of the connection structure, and effectively ensures the stress of the wall, so that the bearing capacity is not reduced.

Figure 1:
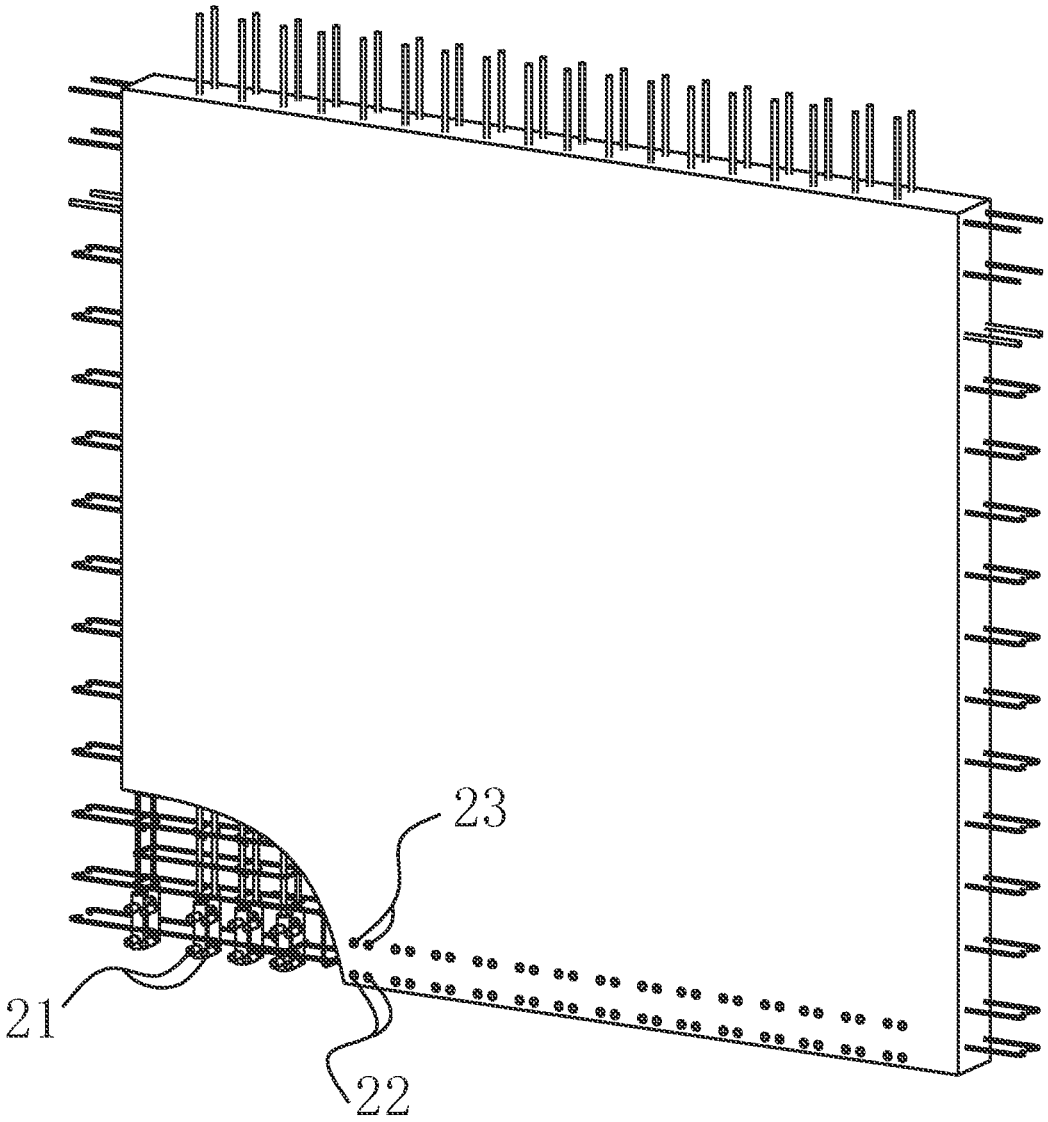
FIG. 1 is a schematic diagram of a sleeve grouting wall structure in the background art.

Reference numerals in FIGS. 1 to 24:

| | |
|---|---|
| 1 prefabricated wall | 2 concrete main body |
| 3 rigid framework | 4 vertical rib |
| 5 mechanical connecting part | 6 bearing and connecting end |
| 7 bearing and connecting cavity | 8 sleeve |
| 9 special-shaped prefabricated wall | 10 upper wall |
| 11 lower wall | 12 fastening component |
| 13 plug rod | 14 locking piece |
| 15 buckle barrel | 16 adapter sleeve |
| 17 cast-in-place layer | 18 overhead area |
| 19 prefabricated floor slab | 20 rigid truss |
| 21 grouting sleeve | 22 grouting hole |
| 23 vent hole | 24 support frame |
| 25 adjustment pad | 26 diagonal brace |

DETAILED DESCRIPTION OF EMBODIMENTS

In the following, the present application is further described in conjunction with the embodiments.

Embodiment 1

Figure 2:
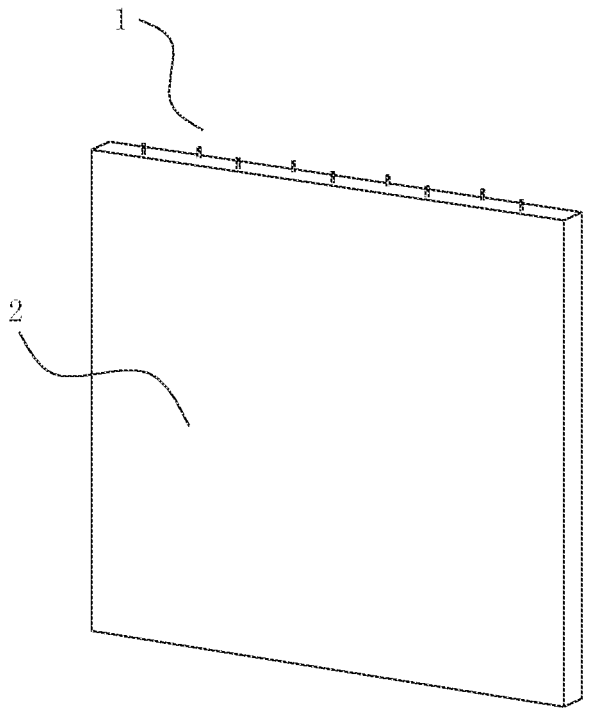
FIG. 2 is a schematic structural diagram of a prefabricated wall of the present application.
Figure 3:
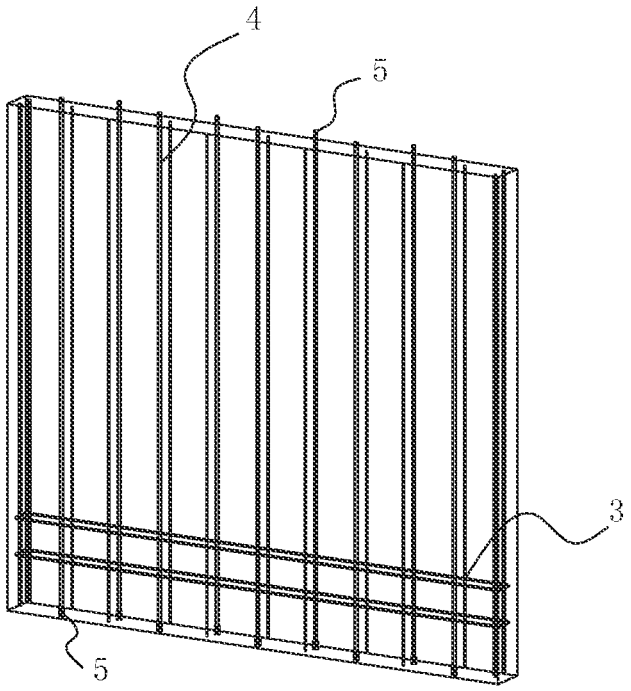
FIG. 3 is a schematic diagram of the internal structure of a prefabricated wall of the present application.

Referring to FIG. 2, an assembled prefabricated wall includes a concrete main body 2 and a rigid framework 3 poured in the concrete main body. The rigid frame is composed of vertical ribs, horizontal ribs and stirrups connected to each other. Rigidity refers to the ability to resist deformation under static load. The rigid framework 3 refers to a support structure, that does not use shrinkable materials or structures, and, that deforms or displaces very little under pressure, including a framework formed by weaving or interspersing and fixing steel bars, composite metals, and rigid fibers. Referring to FIG. 3, the rigid framework 3 includes a group of vertical ribs 4 which are uniformly spaced along the length direction of the wall body, in which at least three vertical ribs 4 are provided. When a number of less than three vertical ribs 4 are provided, even if all the vertical ribs 4 are connected, the connection between prefabricated walls is not stable enough, thus, in order to improve the stability, at least three vertical ribs 4 are required. When the vertical ribs 4 need to be connected according to the architectural design requirements, mechanical connecting parts 5 are formed at ends of the vertical ribs 4 to be connected, so the mechanical connecting parts 5 are all exposed or open on the concrete main body. That is, when connection is needed, it may be directly connected to the fastening component, or at least directly connected to one part of the fastening component, so that the mechanical connecting part 5 is required to be formed at an end head of the vertical rib 4.

This technical solution not only brings the aforementioned effects through the arrangement of the mechanical connecting part, but also overcomes the following disadvantages of the embedded grouting sleeve. Due to the embedded grouting sleeve and the overlapping steel bars in the sleeve, the internal structure of the foot part of the wall is provided with vertical steel bars which are twice as large as that of the wall, plus horizontal infill steel bars, embedded grouting sleeve and spiral stirrups, etc., and the structural parts here are numerous and complex. Meanwhile, due to the lack of more reasonable supporting equipment and perfect construction technology, the positioning of vertical steel bars and sleeves here is relatively more complex, which may easily cause dislocation of grouting sleeves and affect wall splicing when concrete pouring is performed. In addition, in such a complex structure, it is difficult to ensure the vibrating compaction of concrete here. Instead, the arrangement of vertical ribs and mechanical connecting parts in the present embodiment 1 greatly simplifies the internal structure of the prefabricated wall, and the rigid framework in the present embodiment 1 may be prepared according to the traditional manufacturing method of steel cage in cast-in-place without adding other embedded parts.

Figure 4:
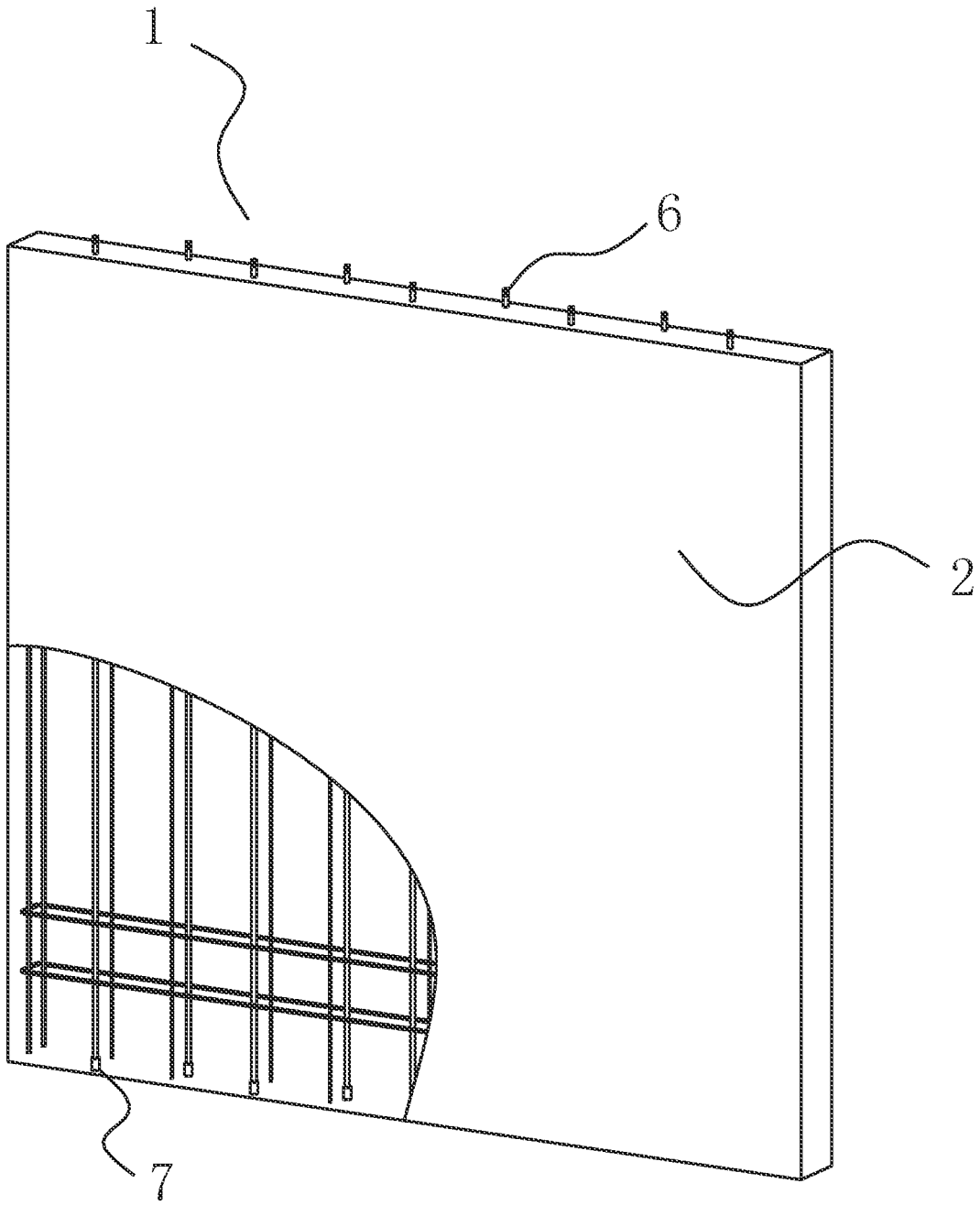
FIG. 4 is a schematic structural diagram of a mechanical connecting part of a prefabricated wall of the present application.
Figure 5:
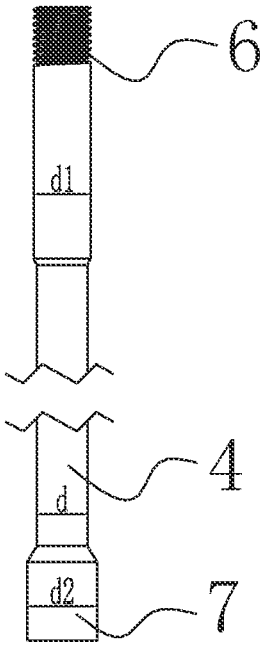
FIG. 5 is a structural schematic diagram of a bearing and connecting end of the present application.
Figure 6:
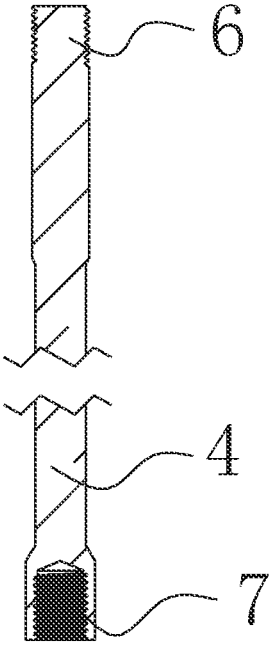
FIG. 6 is a structural schematic diagram of a bearing and connecting cavity of the present application.

As shown in FIG. 4, the mechanical connecting part 5 includes a bearing and connecting end 6 or a bearing and connecting cavity 7, the bearing and connecting end 6 is generally higher than the surface of the concrete main body 2, and the bearing and connecting cavity 7 is generally set to be flush with the surface of the concrete main body 2. The bearing and connecting end 6 or the bearing and connecting cavity 7 is arranged to serve as a connection port for connecting upper and lower walls when the prefabricated wall 1 is assembled, and the bearing and connecting end 6 and the bearing and connecting cavity 7 are provided with corresponding interface structures which may be used for connection according to specific connection manners. For example, if the corresponding fastening components are clamped with them according to the design requirements, clamping grooves or blocks for clamping are arranged on the bearing and connecting end 6 and the bearing and connecting cavity 7. It may also be arranged as threaded connection or pin-key connection. In this embodiment, as shown in FIG. 5 and FIG. 6, thread-based connection has the advantages of clear transmission force, reliable connection, and convenient mounting. The thread connection is preferred, that is, an external thread is provided on the bearing and connecting end 6 and an internal thread is provided in the bearing and connecting cavity 7. In addition, in order to overcome the disadvantage that the grouting sleeve or lap sleeve used for connection and its grouting holes and vent holes occupy too much bottom volume in the prior art, according to the present application, an external dimension of the end mechanical connecting part is shorten and reduced in the same proportion, and a large number of experiments show that the effect is best when the specific dimension is limited as follows, which may be not easy to pull off and may play a role of firm connection. That is, the outer diameter of the bearing and connecting end 6 is 0.7~2 times that of the vertical rib 4, and the outer diameter of the bearing and connecting cavity 7 is 1.2~3 times that of the vertical rib 4. If the outer diameter of the vertical rib 4 is d, the outer diameter of the bearing and connecting end 6 is d1, and the outer diameter of the bearing and connecting cavity 7 is d2, then 2d≥d1≥0.7d, 3d≥d2≥1.2d. This arrangement avoids the phenomenon of cracks and concrete falling off due to the large occupied volume of embedded parts.

Figure 7:
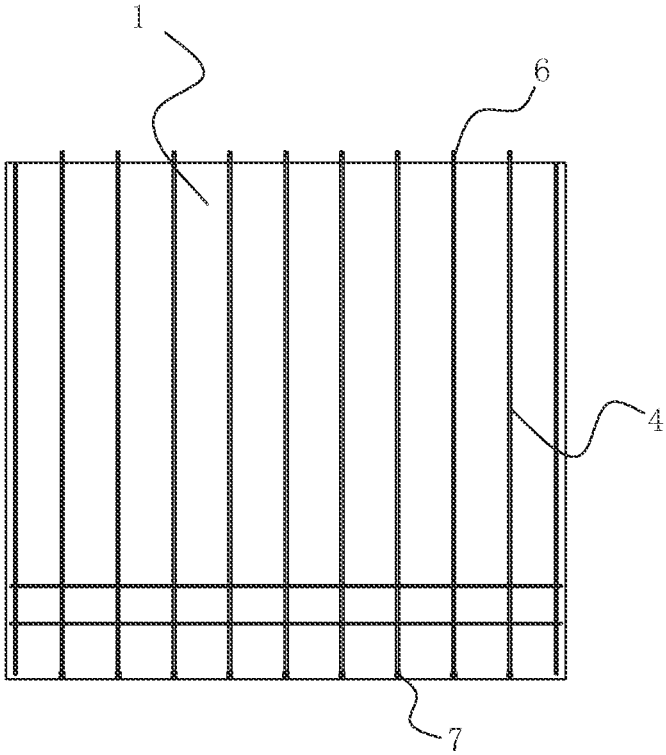
FIG. 7 is a structural schematic diagram of the specific positions of the bearing and connecting end and the bearing and connecting cavity of the present application.

The specific positions of the bearing and connecting end 6 and the bearing and connecting cavity 7 on the end face of the prefabricated wall may be flexibly set. As shown in FIG. 7, multiple bearing and connecting ends 6 are all located at the upper end of the prefabricated wall 1, and multiple bearing cavities 7 are all located at the lower end of the prefabricated wall 1. This arrangement unifies the direction of the bearing and connecting ends 6 and the bearing and connecting cavities 7 on the prefabricated wall 1, which is beneficial to the fixation of the ingredients and framework when the prefabricated wall 1 is prefabricated in the factory; when the prefabricated wall is assembled, because of the consistency of the ends, it is unnecessary to consider the connection direction of the mechanical connecting part 5, which is convenient for mounting and assembly.

Figure 8:
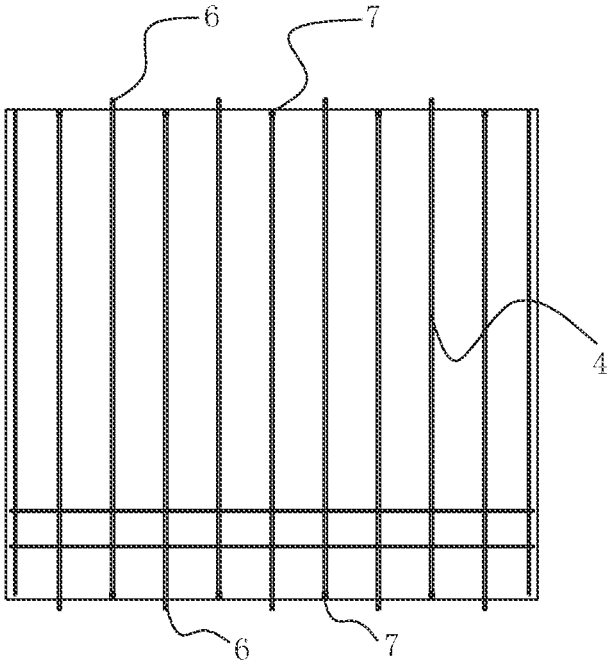
FIG. 8 is a structural schematic diagram of the specific positions of another bearing and connecting end and another bearing and connecting cavity of the present application.

As shown in FIG. 8, the bearing and connecting ends 6 and the bearing and connecting cavities 7 are randomly distributed at the upper and lower ends of the prefabricated wall 1. Although this arrangement is laborious in prefabrication, in wall assembly, because there is a gap between the bearing and connecting ends 6 and the bearing and connecting cavities 7 relative to the prefabricated wall 1 itself, after the connection is completed, the connection point naturally forms a gap, that is, the height of each connection point also forms a connection point with a drop along with the arrangement of the bearing and connecting end 6 and the bearing and connecting cavity 7. In this way, when the connected concrete structure is subjected to a shear force, because the connecting points are not on the same horizontal plane, it may bear greater shear force, and then the stability of the building structure is improved.

Figure 9:
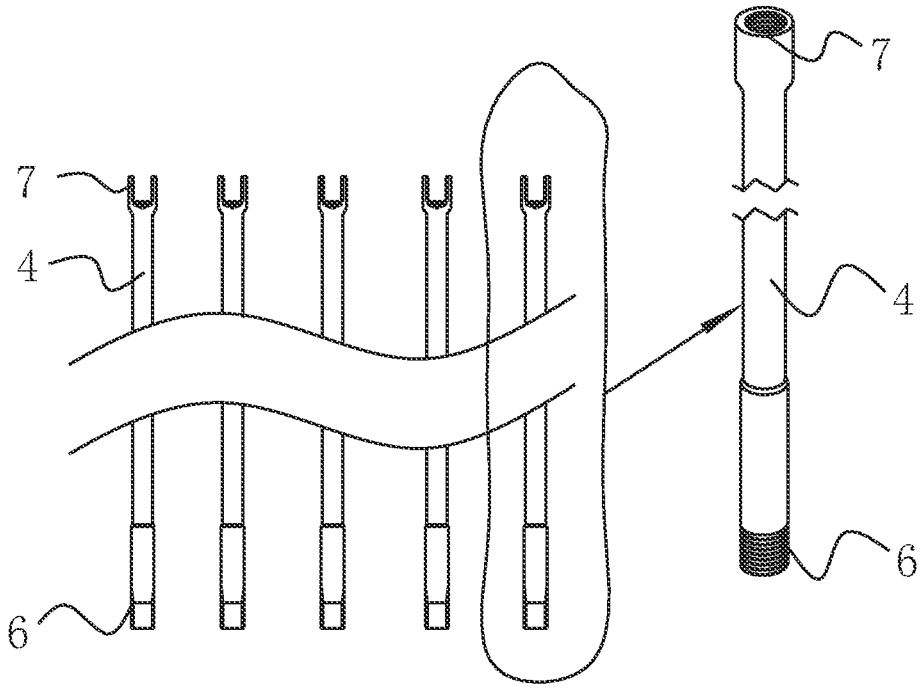
FIG. 9 is a specific structural schematic diagram of the bearing and connecting end and the bearing and connecting cavity of the present application.

As shown in FIG. 9, each of the bearing and connecting ends 6 is formed by processing the end of the vertical rib 4 extending out of one end of the concrete main body 2, and each of the bearing and connecting cavities 7 is formed by upsetting the end of the vertical rib 4 and processing it into an inward concave open cavity along its axial direction. In this way, connecting the prefabricated walls 1 through the bearing and connecting end 6 and the bearing and connecting cavity 7 is equivalent to directly connecting the vertical ribs 4 between the prefabricated walls 1, thus forming vertical through ribs penetrating the structure in the wall structure, better ensuring the structural integrity and improving the stability and safety of the wall.

Figure 10:
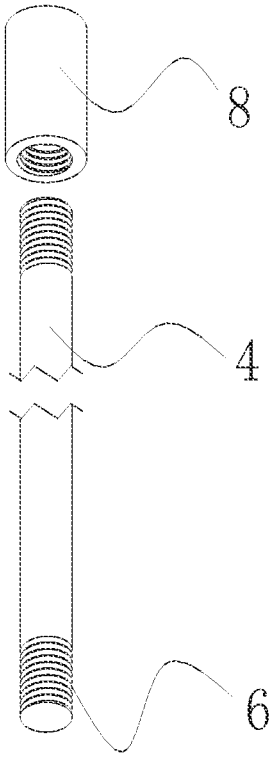
FIG. 10 is a specific structural schematic diagram of another bearing and connecting end and another bearing and connecting cavity of the present application.

As shown in FIG. 10, the bearing and connecting end 6 is formed by the end of the vertical rib 4 extending out of the concrete main body 2, and the bearing and connecting cavity 7 is formed based on the sleeve 8 rigidly connected with the end of the vertical rib 4, and the end of the sleeve 8 far away from the vertical rib 4 forms an open bearing and connecting cavity. Rigid connection here means that when one object is displaced or stressed, the other object connected with it may not be displaced or deformed relative to the first object, that is, the two objects are connected as a whole. It may also be threaded connection, pin-key clamping, welding, heat treatment or cold rolling connection, etc. In this way, although the integrity of the bearing and connecting cavity and the vertical rib is slightly lost, the convenience of mounting and processing is greatly improved, and the processing and assembly may be extremely flexible, and the processing cost is also lower.

Embodiment 2

Figure 11:
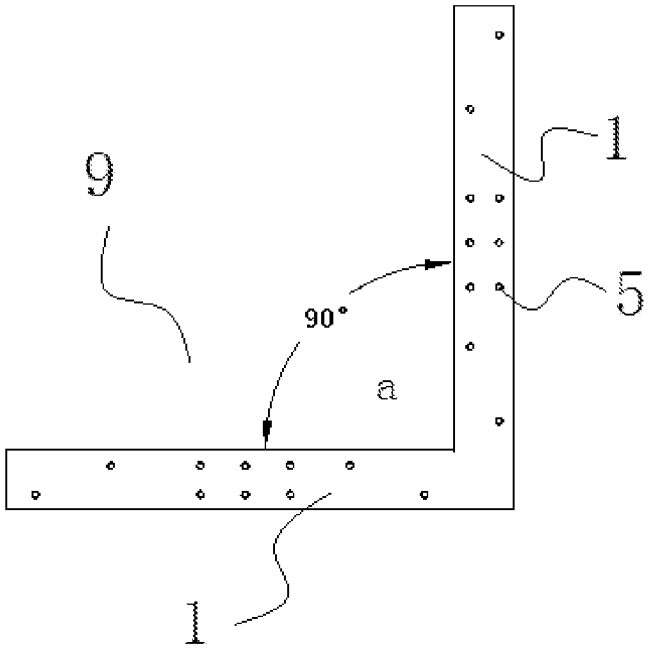
FIG. 11 is a schematic structural diagram of a prefabricated wall of the present application.
Figure 12:
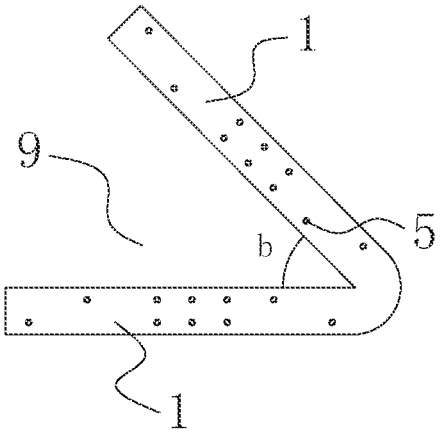
FIG. 12 is a schematic structural diagram of another prefabricated wall of the present application.
Figure 13:
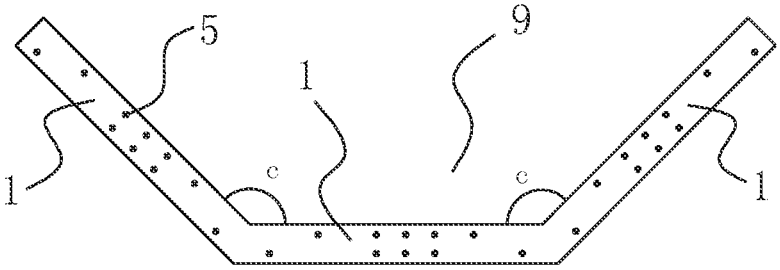
FIG. 13 is a schematic structural diagram of still another prefabricated wall of the present application.

As shown in FIG. 11 to FIG. 13, a special-shaped prefabricated wall 9 is composed of single prefabricated walls 1, that is, the prefabricated walls adjacent to each other among multiple prefabricated walls 1 are assembled at a certain angle in the horizontal direction. As the assembly manner or horizontal connection is not within the protection scope of the present application, and the assembly manner may be obtained by the person skilled in the art according to the prior art, of course, the connection of horizontal ribs between prefabricated walls may also adopt the above-mentioned vertical rib structure and the connection manner described later in the case, which is not repeated here. The present application lies in that the special-shaped prefabricated wall 9 is formed by combining the prefabricated walls 1, so the mechanical connecting part 5 in the longitudinal direction of the special-shaped prefabricated wall 9 and the embedded skeleton structure in the special-shaped prefabricated wall 9 all originate from the prefabricated wall 1, thus the special-shaped prefabricated wall 9 integrates the advantages of the prefabricated wall 1 itself. In addition, the special-shaped prefabricated wall 9 provides a feasible practical basis for the realization of prefabricating complex walls. That is, when the special-shaped prefabricated wall 9 is prefabricated integrally, because of its simple internal skeleton, it is very convenient to fix the skeleton in the mold. Moreover, the internal embedded parts are basically ignored, and even for complex walls, the wall properties may not change, which provides great convenience and practicality for prefabricating complex walls. Of course, because prefabricated wall 1 and special-shaped prefabricated wall 9 only change in shape, and their key vertical ribs and mechanical connecting parts are the same, special-shaped prefabricated wall 9 may be regarded as a deformation of prefabricated wall, so the prefabricated wall 1 in this case includes a straight wall and a special-shaped wall.

In this embodiment, as shown in FIG. 11, the prefabricated wall 1 is an L-shaped prefabricated wall, and the included angle ∠α between the inner walls of the wall is 90 degrees, and a mechanical connecting part 5 is arranged in the longitudinal direction of the wall to facilitate the connection between the walls.

In this embodiment, as shown in FIG. 12, the prefabricated wall 1 is a V-shaped prefabricated wall, and the included angle ∠b between the inner walls of the wall is less than 90 degrees, and a mechanical connecting part 5 is arranged in the longitudinal direction of the wall to facilitate the connection between the walls.

In this embodiment, as shown in FIG. 13, the prefabricated wall 1 is an open isosceles trapezoidal prefabricated wall, where the included angle ∠c between the inner walls of adjacent walls is 91~179 degrees, and a mechanical connecting part 5 is arranged in the longitudinal direction of the wall to facilitate the connection between the walls.

Embodiment 3

Figure 14:
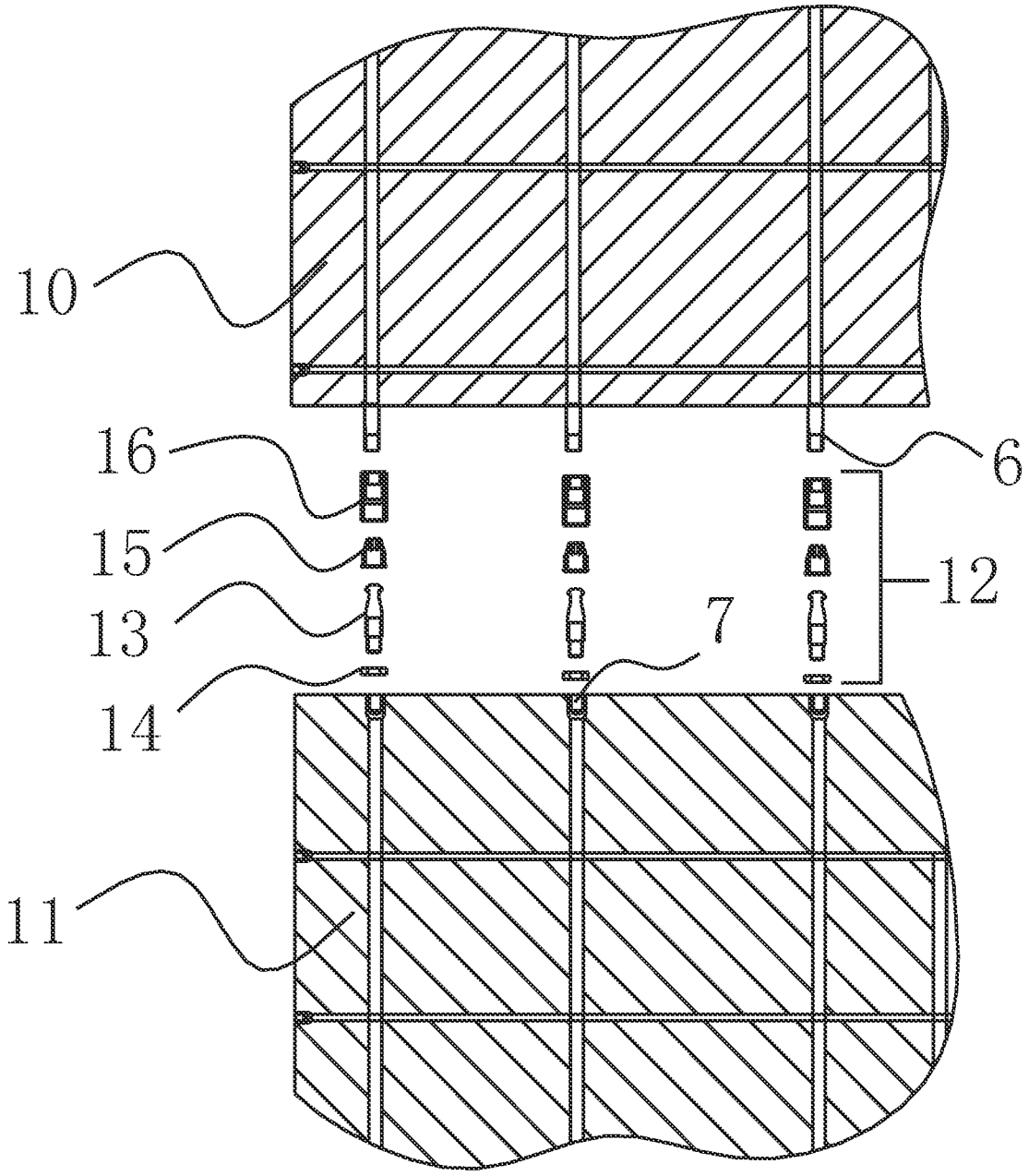
FIG. 14 is a schematic diagram of the pre-connection structure of the connection structure of the prefabricated wall of the present application.
Figure 15:
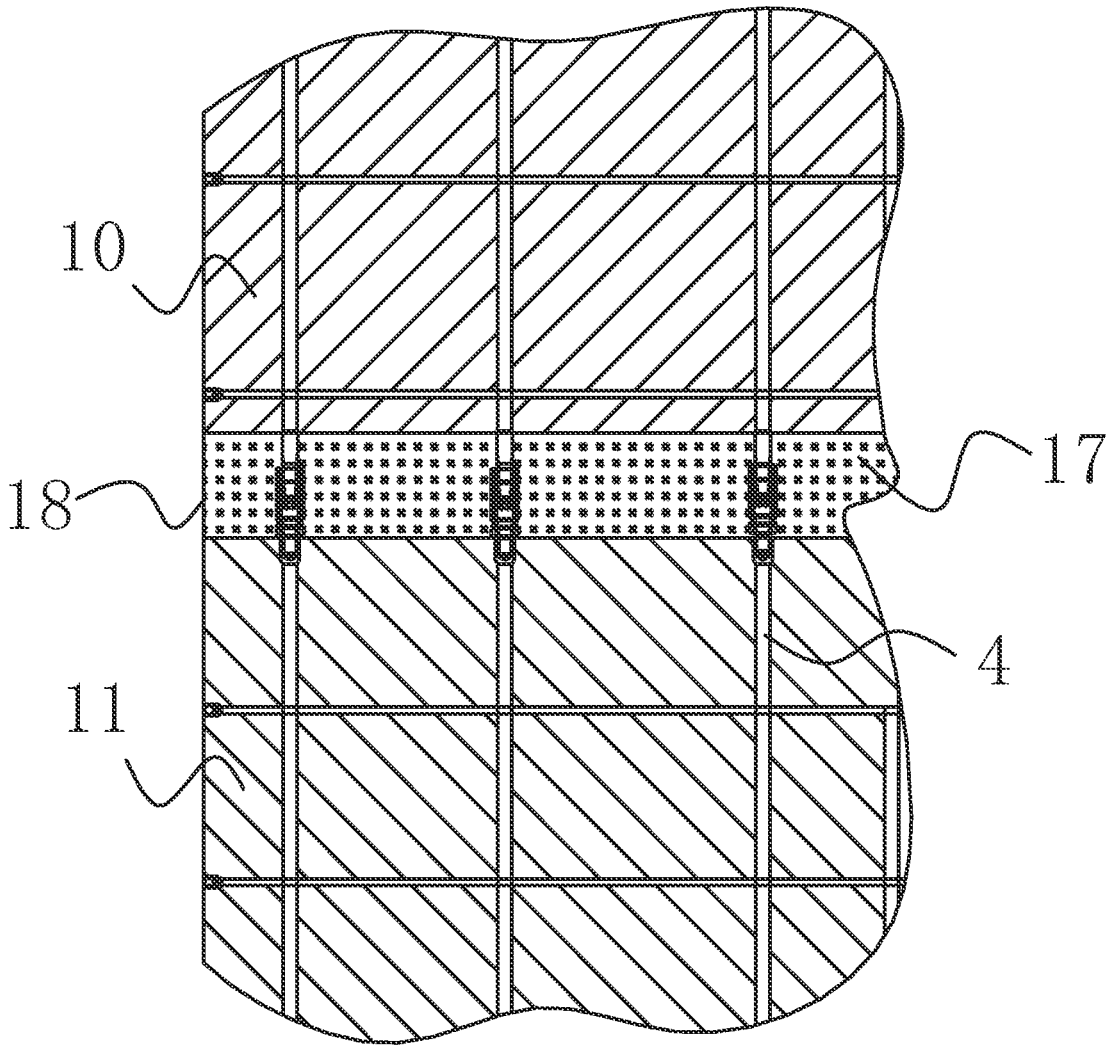
FIG. 15 is a structural schematic diagram of a connection structure of the prefabricated wall according to the present application.

As shown in FIG. 14 and FIG. 15, in an assembly structure of a prefabricated building, an upper wall 10 is the prefabricated wall 1 in embodiment 1 or the special-shaped prefabricated wall 9 in embodiment 2 which is set to match the upper end face (hereinafter referred to as the upper wall).

A lower wall 11 is the prefabricated wall 1 in embodiment 1 or the special-shaped prefabricated wall 9 in embodiment 2 (hereinafter referred to as the lower wall) which is set to match the lower end face. The end-face matching means that the wall or the mechanical connecting parts arranged on the end face of the wall correspond to each other. Specifically, when the upper and lower end faces of the two walls are opposite to each other, the mechanical connecting part 5, which is located on the same axis and used for connection between the walls, meets the requirements of reinforcement connection between the walls. The common feature of the upper wall 10 and the lower wall 11 is that the end heads of the vertical ribs 4 arranged longitudinally according to the design requirements are formed with corresponding mechanical connecting parts 5 on the wall. The upper wall 10 and the lower wall 11 connect with the mechanical connecting part 5 through the fastening component 12 and are locked and fixed to form an assembly structure of a prefabricated building. The fastening component 12 is assembled and connected correspondingly to an overhead area 18 left between the walls.

The connecting structure of the wall further includes a cast-in-place layer 17. After the fastening component 12 is assembled and firmly connected in the overhead area 18 formed between the upper wall 10 and the lower wall 11, the cast-in-place layer 17 fills and compacts the overhead area 18 to make the upper wall 10 and the lower wall 11 become a whole.

The connection between the upper wall 10 and the lower wall 11 is to assemble the fastening component 12 corresponding to the overhead area 18 left between the walls through the fastening component 12. That is, the overhead area 18 for connection is formed between the upper wall 10 and the lower wall 11, and the fastening component 12 is assembled in the overhead area 18. The fastening component 12 only needs to connect the upper and lower walls relatively fixedly through reserved connecting ports on the connecting walls, so that the wall connection meets the design requirements. Therefore, there are many options for the combination mode and connection structure of the fastening component 12. Those skilled in the art should understand that the connection manner of main ribs in the rigid skeleton and the fastening component between the main ribs may be used here, for example, welding connection, threaded connection, pin-key connection, etc. Here, one solution of threaded connection is described. The fastening component 12 includes a plug rod 13, a locking piece 14, a buckle barrel 15 and an adapter sleeve 16. The mechanical connecting part 5 of the upper wall 10 is correspondingly connected to the adapter sleeve 16, and the mechanical connecting part 5 of the lower wall 11 is correspondingly connected to the plug rod 13; or, the mechanical connecting part 5 of the upper wall 10 is correspondingly connected to the plug rod 13, and the mechanical connecting part 5 of the lower wall 11 is correspondingly connected to the adapter sleeve 16. The buckle barrel 15 is fixed in the adapter sleeve 16, the plug rod 13 is inserted into the buckle barrel 15, and the locking piece 14 is sleeved on the outer edge of the plug rod 13, so that the plug rod 13 is clamped with the buckle barrel 15 without gap. Therefore, the upper wall 10 and the lower wall 11 are firmly connected in the longitudinal direction. With this connection structure, the connected part is no longer hidden in the wall, and it would be clearly observed whether the connection is in place, so as to ensure the stability of the wall connection. In addition, this connection structure directly connects the longitudinal (vertical) ribs in the wall, and the force transmission is more direct, which improves the overall ductility of the wall and the building composed of the wall.

When the mechanical connecting part 5 of the upper wall 10 is the bearing and connecting cavity 7 and the mechanical connecting part 5 of the lower wall 11 is the bearing and connecting end 6, the plug rod 13 is mounted at the bearing and connecting cavity 7 after the upper wall 10 is prefabricated, and the adapter sleeve 16 is mounted at the bearing and connecting end 6 after the lower wall 11 is prefabricated, and the buckle barrel 15 is accommodated and fixed in the adapter sleeve 16. When the upper wall 10 is connected to the lower wall 11, the height of the upper wall 10 is adjusted and the plug rod 13 is inserted into the buckle barrel 15. The plug connector on the plug rod 13 spreads out and passes through an elastic sheet on the buckle barrel 15, and the elastic sheet naturally returns to the contracted state, thus forming the function of limiting and stopping the plug rod 13. Then, the locking piece 14 on the plug rod 13 is tightened, so that the plug rod 13 is clamped with the buckle barrel 15 without a gap.

When the mechanical connecting part 5 of the upper wall 10 is the bearing and connecting end 6 and the mechanical connecting part 5 of the lower wall 11 is the bearing and connecting cavity 7, the connection between the upper wall 10 and the lower wall 11 is just the opposite of the above situation.

Figure 16:
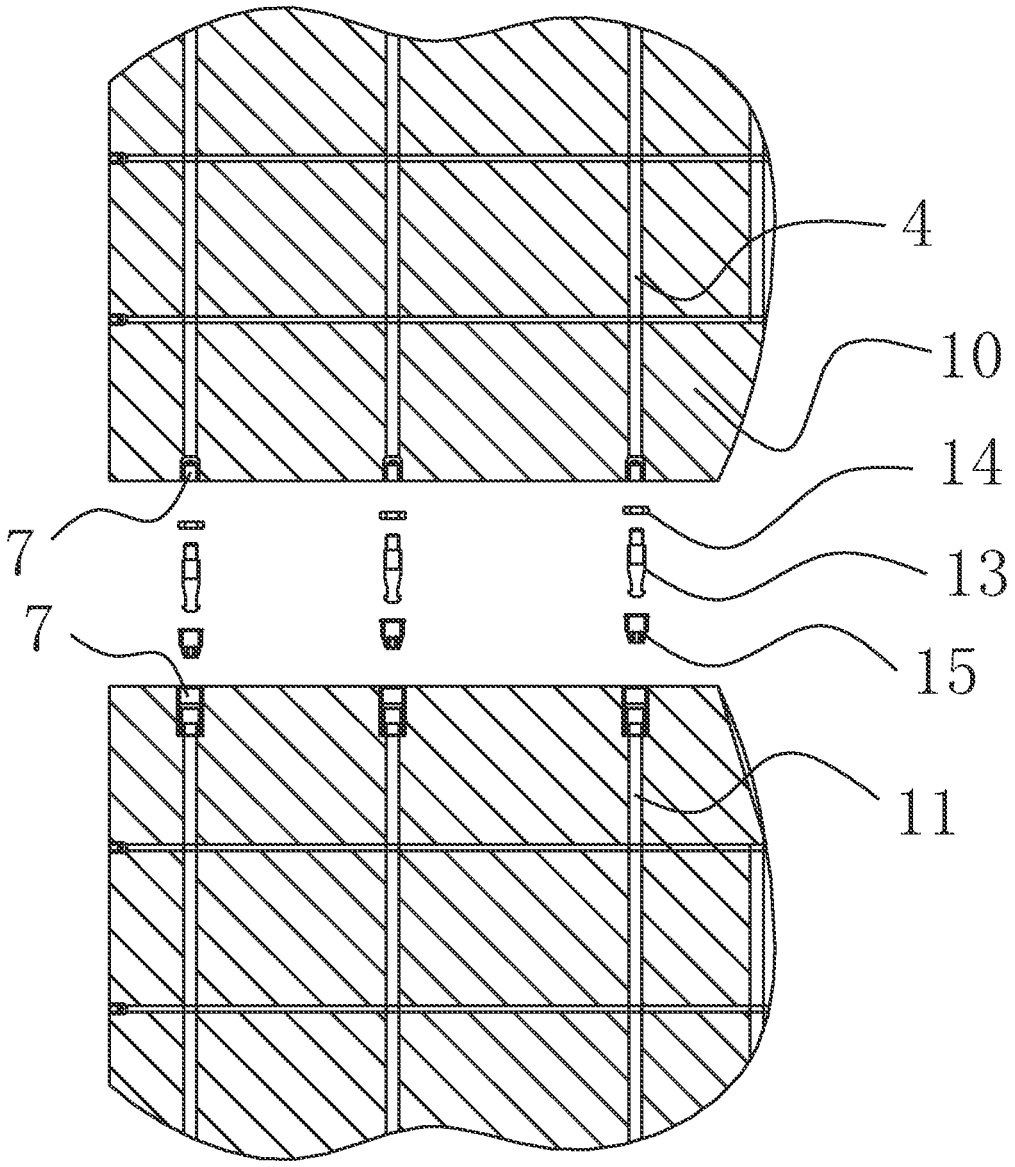
FIG. 16 is a schematic diagram of a pre-connection structure of the connection structure of another prefabricated wall of the present application.
Figure 17:
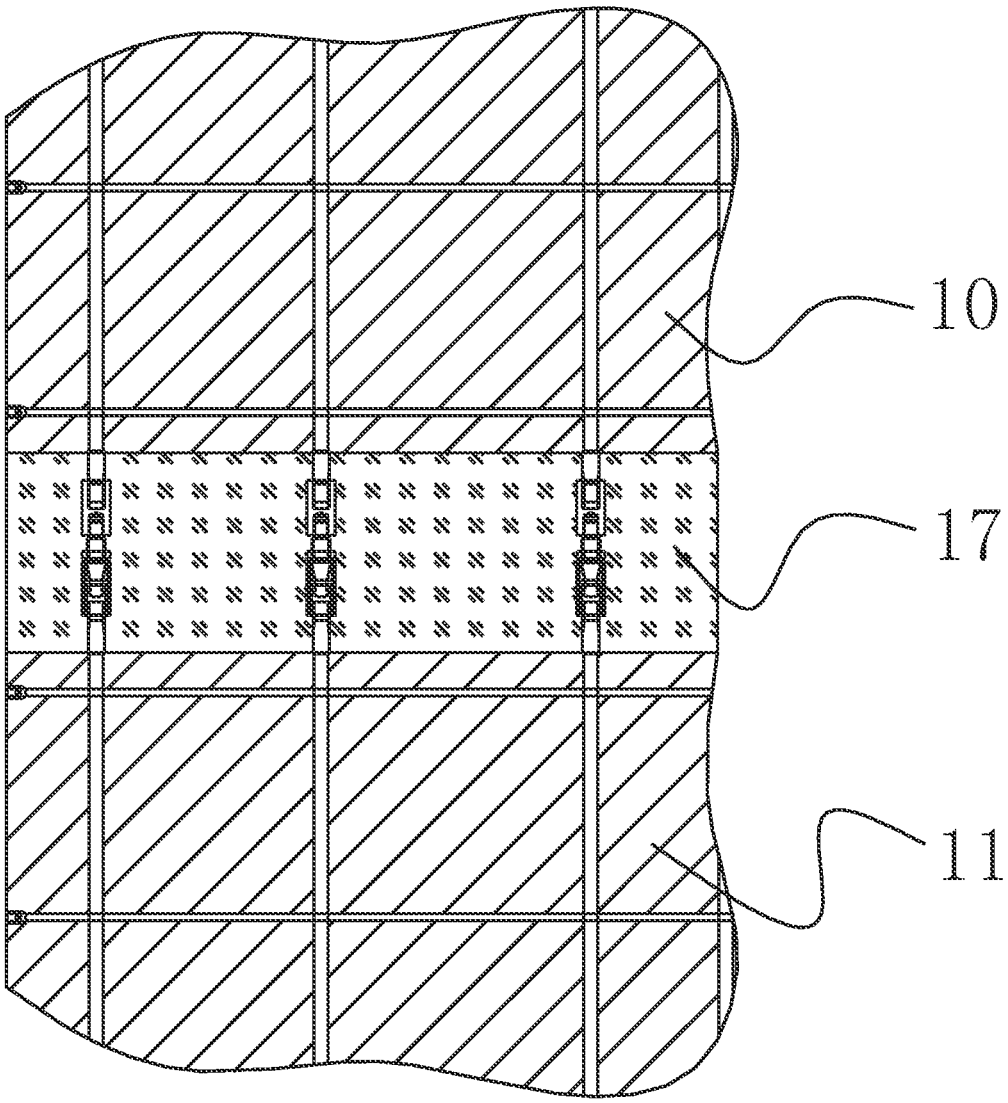
FIG. 17 is a structural schematic diagram of a connection structure of another prefabricated wall.

As shown in FIG. 16 and FIG. 17, when the mechanical connecting part 5 of the upper wall 10 is the bearing and connecting end 6 and the mechanical connecting part 5 of the lower wall 11 is the bearing and connecting end 6, after the prefabrication of the upper wall 10 is completed, the adapter sleeve 16 is mounted at the bearing and connecting end 6, and then the plug rod 13 is mounted in the adapter sleeve 16. The connecting cavity of the adapter sleeve 16 needs to be shaped as an internal shape of the bearing and connecting cavity 7. After the prefabrication of the lower wall 11 is completed, the adapter sleeve 16 is mounted at the bearing and connecting end 6, and the buckle barrel 15 is accommodated and fixed in the adapter sleeve 16. When the upper wall 10 is connected to the lower wall 11, the height of the upper wall 10 is adjusted, the plug rod 13 is inserted into the buckle barrel 15, and the plug connector on the plug rod 13 is opened and passes through the elastic sheet on the buckle barrel 15. The elastic sheet naturally returns to the contracted state, thus forming the function of limiting and stopping the plug rod 13, and then tightening the locking piece 14 on the plug rod 13, so that the plug rod 13 is clamped with the buckle barrel 15 without a gap, thus firmly connecting the vertical ribs together.

Figure 18:
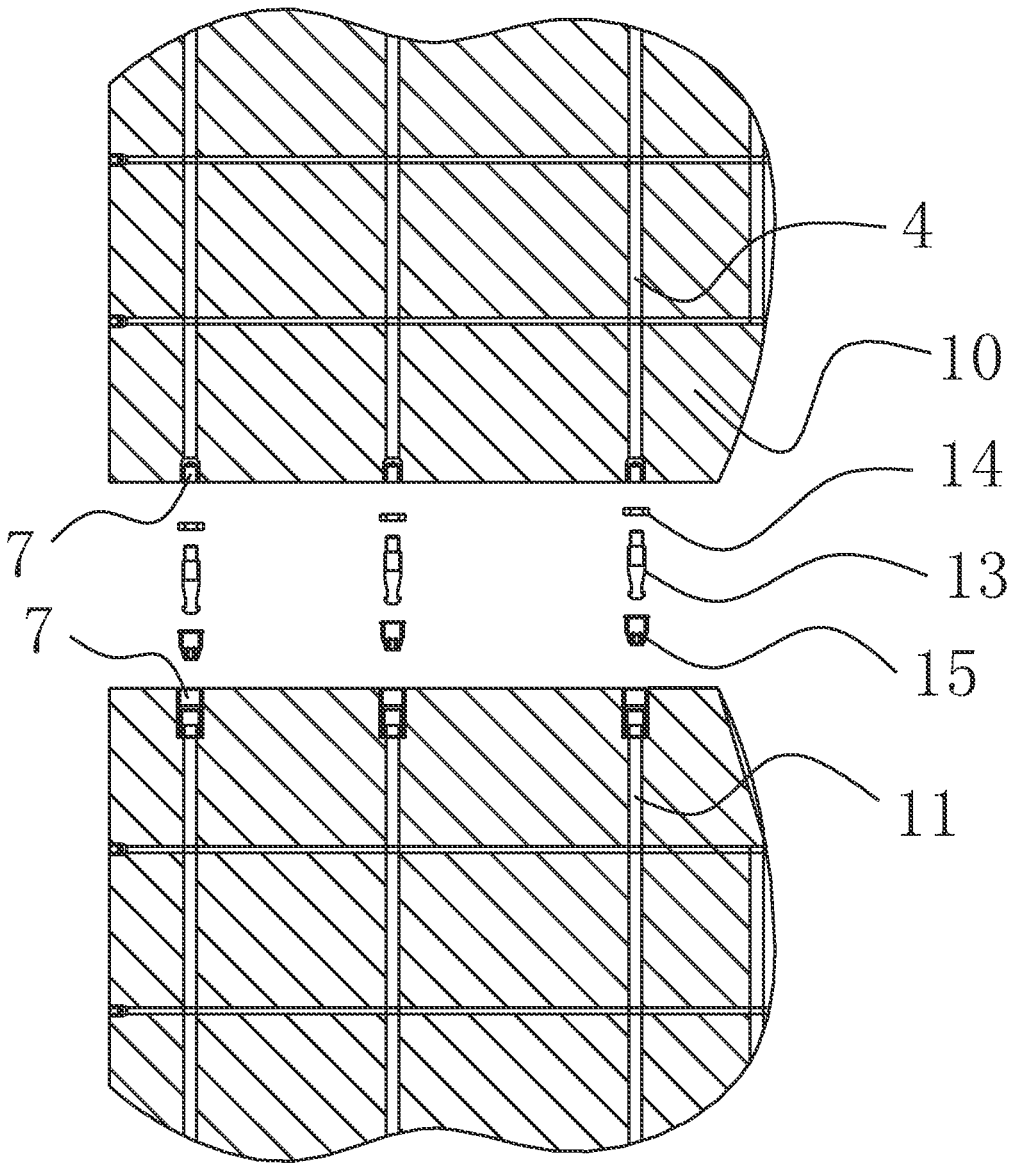
FIG. 18 is a schematic diagram of a pre-connection structure of the connection structure of another prefabricated wall.
Figure 19:
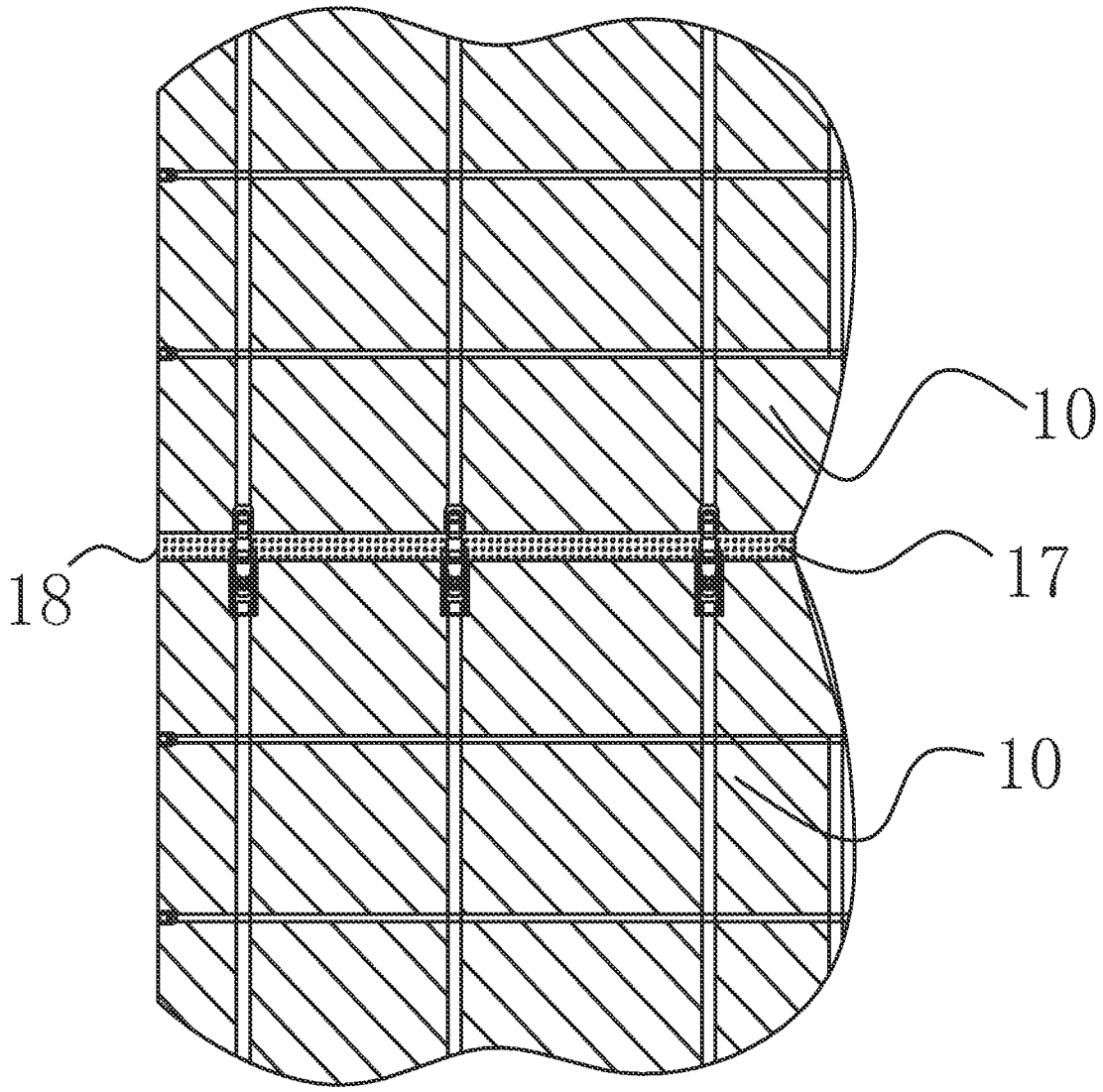
FIG. 19 is a structural schematic diagram of a connection structure of another prefabricated wall.

As shown in FIG. 18 and FIG. 19, when the mechanical connecting part 5 of the upper wall 10 is the bearing and connecting cavity 7, and the mechanical connecting part 5 of the lower wall 11 is the bearing and connecting cavity 7, the bearing and connecting cavity 7 of the lower wall 11 is shaped as an inner cavity of the adapter sleeve 16. After the prefabrication of the upper wall 10, the plug rod 13 is mounted in the bearing and connecting cavity 7, and after the prefabrication of the lower wall 11, the buckle barrel 15 is directly accommodated and fixed in the bearing and connecting cavity 7. When the upper wall 10 is connected to the lower wall 11, the height of the upper wall 10 is adjusted, the plug rod 13 is inserted into the buckle barrel 15, and the plug connector on the plug rod 13 is opened and passes through the elastic sheet on the buckle barrel 15. The elastic sheet naturally returns to the contracted state, thus forming the function of limiting and stopping the plug rod 13, and then tightening the locking piece 14 on the plug rod 13, so that the plug rod 13 is clamped with the buckle barrel 15 without a gap, thus firmly connecting the vertical ribs together.

Embodiment 4

Figure 20:
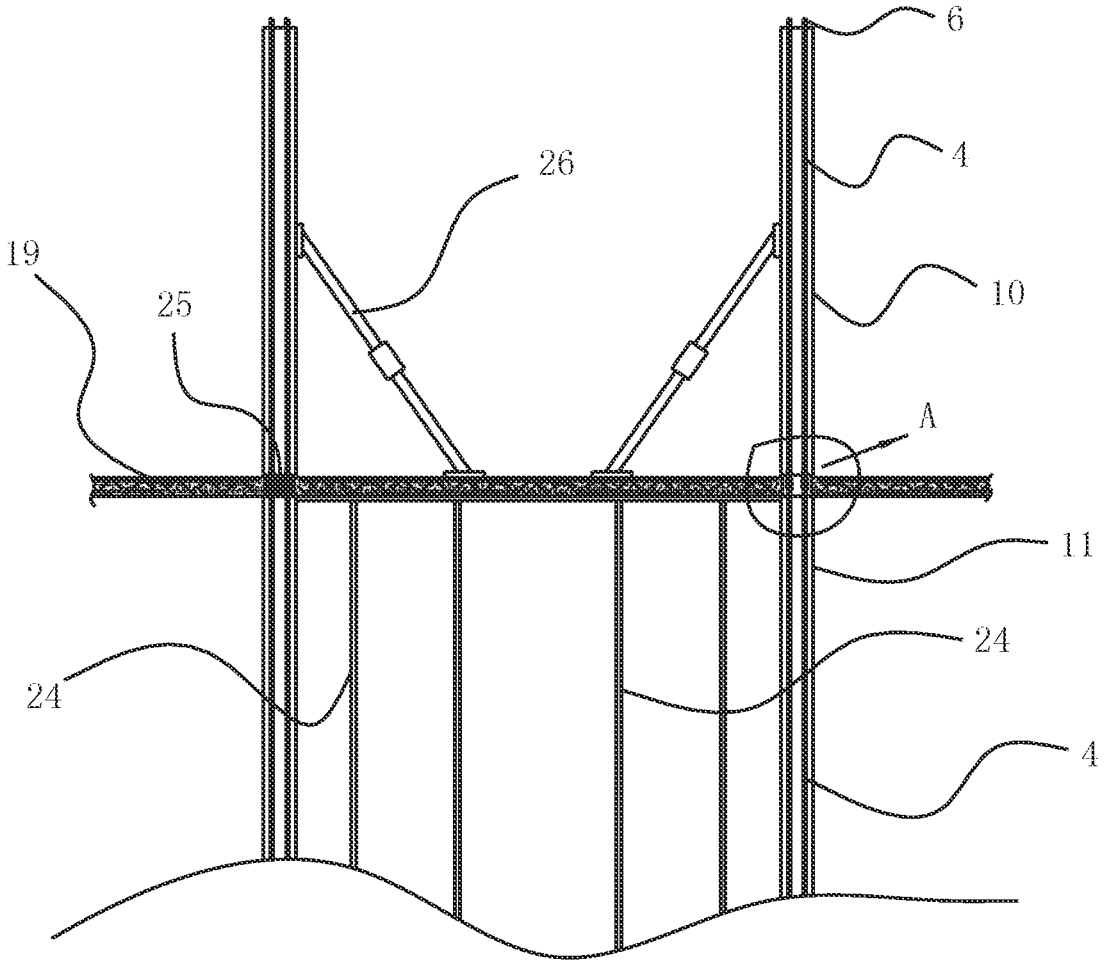
FIG. 20 is a structural schematic diagram of the connection structure of the prefabricated wall of embodiment 4.
Figure 21:
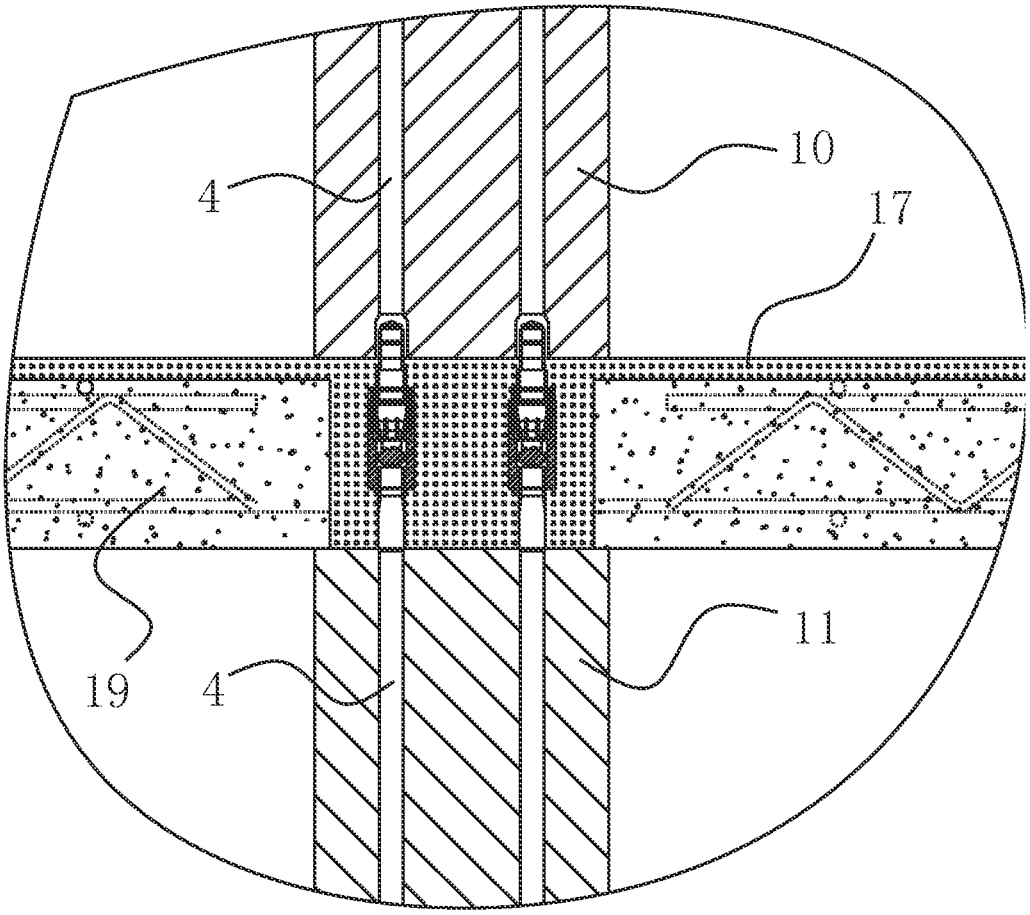
FIG. 21 is a schematic diagram of an enlarged structure of position A in FIG. 20.

As shown in FIG. 20 and FIG. 21, an assembly structure of a prefabricated building includes the assembly structure of the wall in embodiment 4, and further includes a prefabricated floor slab 19 and a cast-in-place layer 17. Lower edges of the prefabricated floor slabs 19 are overlapped on the adjacent lower walls 11, and the cast-in-place layer 17 fills the assembly gap among the prefabricated floor slabs 19, the upper walls 10 and the lower walls 11. In addition, the overhead area 18 is filled to be at least flush with the lower end face of the upper wall 10 and formed by the prefabricated floor slab 19 and the upper wall 10 and the lower wall 11, that is, the height of the cast-in-place layer in the vertical direction is at least flush with the lower end face of the upper wall 10. The cast-in-place layer 17 is a liquid concrete filler or a modified filler, which may meet the mechanical requirements of the building filler. Specifically, it may also be fresh concrete with low slump, which is made of sand, stone, cement, water, additives, admixtures, etc., which are accurately measured and made by a concrete mixer.

In the assembly structure of this embodiment, the assembly structure of the upper and lower walls adopts the assembly structure shown in FIG. 14. That is, the mechanical connecting part 5 of the upper wall 10 is the bearing and connecting cavity 7, and the mechanical connecting part 5 of the lower wall 11 is the bearing and connecting end 6, and the vertical ribs 4 are connected as a whole by the fastening component 12. Since the end faces between the walls have fastening components 12, the prefabricated floor slab 19 may only be horizontally overlapped between the lower walls 11, and the horizontal ribs between two prefabricated floor slabs 19 also need to be overlapped. In this way, there must be an assembly gap between the prefabricated floor slabs 19, the upper wall 10 and the lower wall 11. The assembly gap includes the overhead area 18 between the lower end face of the upper wall 10 and the upper end face of the lower wall 11, and a space between the upper surface of the prefabricated floor slab 19 and the plane where the lower end face of the upper wall 10 lies. That is, the area filled by the cast-in-place layer 17 includes the overhead area 18 between the lower end face of the upper wall 10 and the upper end face of the lower wall 11, and the space between the upper surface of the prefabricated floor slab 19 and the plane where the lower end face of the upper wall 10 lies. In the present application, after all the reinforcing ribs that need to be connected between the walls are firmly connected, the cast-in-place layer 17 is used to fill the assembly gap. On one hand, the mechanical connecting part is visible and controllable, and the connection quality is ensured; on the other hand, the connecting structure of building components is integrated into a whole, and multiple through ribs are formed in the connecting structure, which effectively improves the seismic, tensile and pullout resistance of the building structure, and makes the whole building structure safer and more reliable.

Embodiment 5

Figure 22:
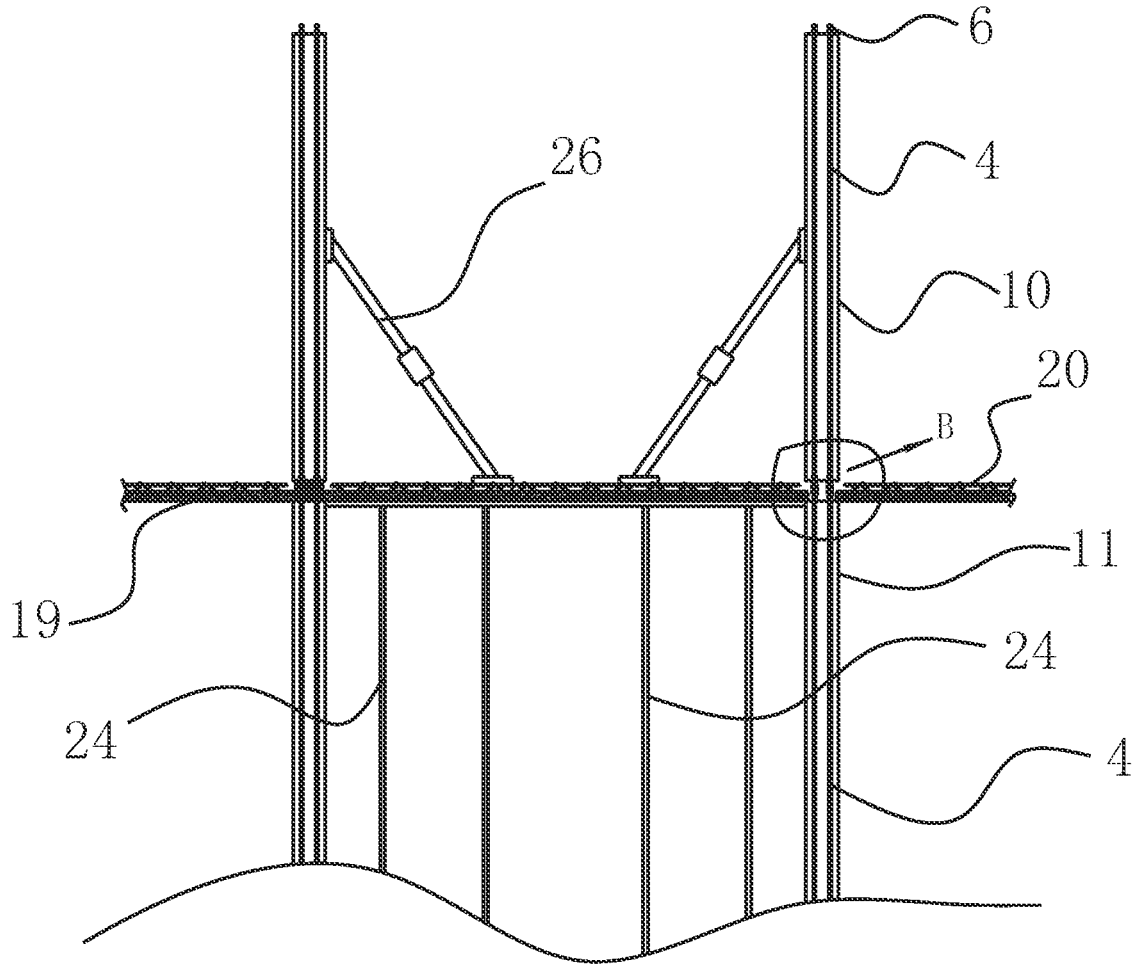
FIG. 22 is a structural schematic diagram of the connection structure of the prefabricated wall of embodiment 5.
Figure 23:
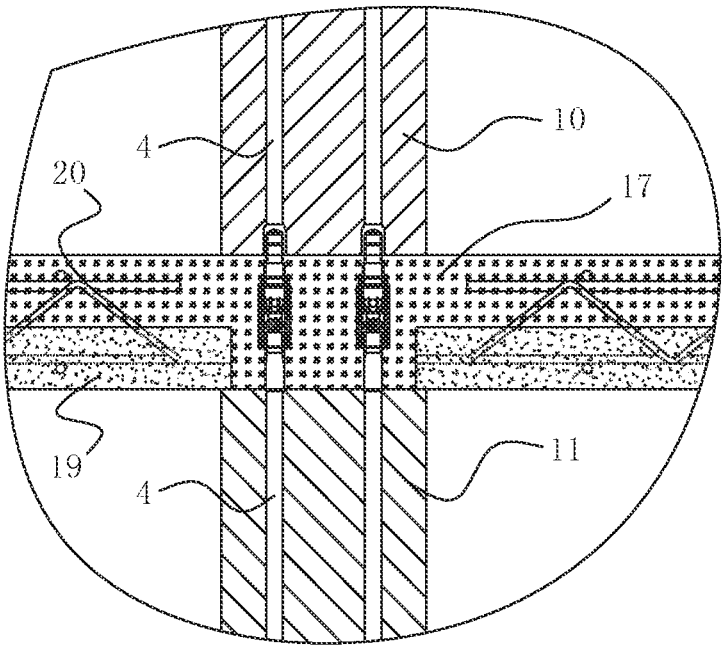
FIG. 23 is a schematic diagram of an enlarged structure of position B in FIG. 22.

As shown in FIG. 22 and FIG. 23, this embodiment is basically the same as embodiment 4, except that a rigid truss 20 is exposed on the upper surface of the prefabricated floor slab 19, which is convenient for fixing attachments or embedded objects in the prefabricated floor slab 19. Attachments or embedded objects of the prefabricated floor slab 19 are fixed in the rigid truss 20 or the gap between the rigid truss 20 laid on the prefabricated floor slab 19, and the attachments or embedded objects include horizontal ribs or longitudinal ribs of the prefabricated floor slab 19, electric wire pipelines, air conditioning pipelines, floor heating pipelines, water pipelines and the like. In this way, the cast-in-place layer 17 covers the rigid truss 20, and these attachments or embedded objects are fixed in the floor, so that the surface of the building is fresh and clean, which avoids the damage to the building structure caused by grooving during later decoration, and has good economic effect, saving resources and reducing costs.

Figure 24:
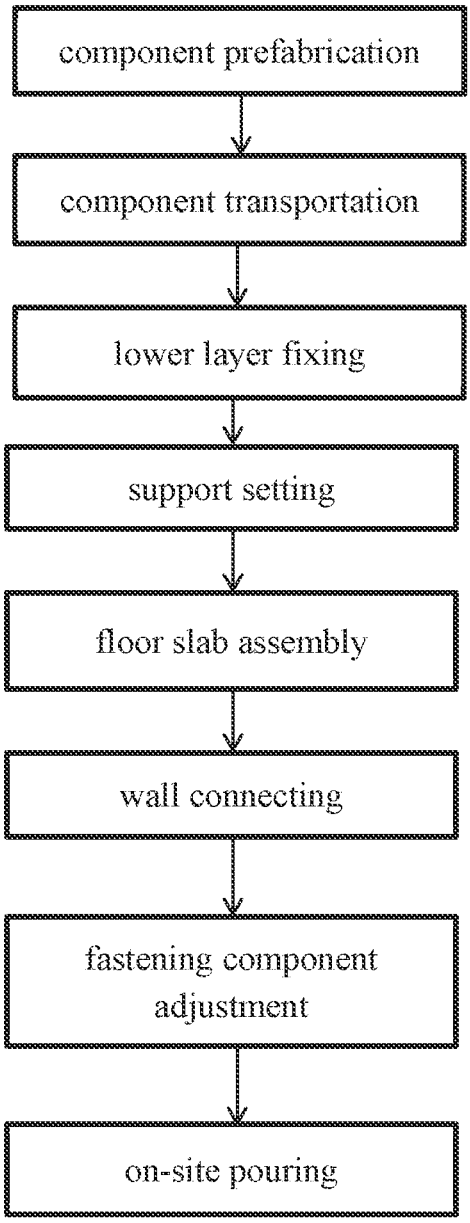
FIG. 24 is a schematic flow diagram of the construction method.

As shown in FIG. 24, a construction method of a prefabricated building assembly structure is further explained, especially the construction method of the assembly structure in embodiment 4 and embodiment 5, including the prefabricated floor slabs 19, the upper wall 10 and the lower wall 11. The prefabricated floor slabs 19 are placed on the upper ends of every two adjacent lower walls 11 by support frames 24, and the upper walls 10 are suspended above the lower walls 11 by a thickness higher than the prefabricated floor slabs 19, and the upper walls 10 are opposite to the lower walls 11. After the reinforcing rib is firmly connected in the overhead area 18 between the upper wall 10, the lower wall 11 and the prefabricated floor slab 19, the assembly gap is filled with the cast-in-place layer 17. The cast-in-place layer 17 is at least flush with the lower end face of the upper wall 10 to fill the overhead area 18 formed by the prefabricated floor slab 19 and the upper wall 10 and the lower wall 11.

The construction method of the assembly structure of the building is to construct in sequence according to the following steps:

- step for component prefabrication: prefabricating the prefabricated wall 1 and the prefabricated floor slab 19;
- step for component transportation: transporting the finished assembled prefabricated wall 1 and the prefabricated floor slab 19 to the construction site, and assembling the fastening components 12 to the part of the prefabricated wall 1 and the prefabricated floor slab 19 that need to be connected;
- step for lower wall fixing: mounting the lower wall 11 on the assembled floor;
- step for floor slab assembly: laying the prefabricated floor slab 19 between the lower walls 11: specifically, in order to facilitate and prevent the floor slab from falling, step for support setting may be carried out first: according to the design requirements, a support frame 24 for supporting the prefabricated floor slab is assembled around the lower wall, and the support frame is assembled and fixed to be flush with the upper end face of the lower wall 11, so that the support frame 24 supports the prefabricated floor slab 19 in the horizontal direction. The support frame 24 may be a horizontal and vertical support rib or a triangular support frame 24;
- step for wall connecting: hoisting the upper wall 10 to the designated position; specifically, in order to better position the upper wall 10, an adjustment pad 25 is arranged between the upper wall 10 and the lower wall 11, and the level and height of a long side of the upper wall 10 may be adjusted by increasing or decreasing the number of the adjustment pad 25, a diagonal brace 26 is provided between the prefabricated floor slab 19 and the upper wall 10, and the vertical and short side levels and inclinations of the upper wall 10 are adjusted by the diagonal brace 26;

step for fastening component adjustment: between the upper wall 10 and the lower wall 11, the fastening component 12 is respectively and correspondingly fixedly connected to the mechanical connecting part 5, and the fastening components 12 are adjusted to meet the requirements of pull-out and tension resistance of the connection between the upper wall 10 and the lower wall 11;

step for on-site pouring: pouring concrete filler into the assembly gap between the prefabricated floor slabs 19 and the upper wall 10 and the lower wall 11 on the construction site, so that the prefabricated floor slabs 19, the upper wall 10 and the lower wall 11 form an integral structure without gaps, the cast-in-place layer 17 is formed at the part poured on site, and the cast-in-place layer 17 is filled with liquid concrete, it is the fresh concrete with low slump, which is made of sand, stone, cement, water, additives, admixtures, etc., which are accurately measured and made by a concrete mixer.

repeat the step for support setting to the step for on-site pouring until the construction of the prefabricated building is completed.

Compared with the sleeve grouting technology, this construction method uses cast steel or profile cutting to form a grouting sleeve, which has a higher processing cost, a longer lap length and requires more steel bars and grouting materials. In this way, the cost of prefabricated wall is almost twice as high as that of cast-in-place wall, and the field grouting work is heavy, so the construction period all depends on the grouting speed of field workers. However, workers are limited by skills proficiency, work seriousness and other factors, and grouting is often not dense in the construction process, so the quality is not easy to be ensured. Instead, the present application overcomes the shortcomings of the existing assembly structure, such as slow mounting speed and difficult guarantee of efficiency and quality, optimizes the connection node structure between the wall and the floor slab, and makes the assembly structure reliable in connection, simple in structure, convenient in construction and easy to mount.

The invention claimed is:

1. An assembly structure of an assembled building, comprising an upper wall, a lower wall, and a fastening component, wherein the upper wall and the lower wall are of a prefabricated wall of an assembled building, and the upper wall is located above the lower wall, and the vertical ribs in the upper wall are mechanically connected to the vertical ribs in the lower wall by the fastening component, wherein the prefabricated walls of the assembled building, comprising a concrete main body and a rigid framework poured in the concrete main body, wherein the rigid framework comprises n vertical ribs extending longitudinally, and n is an integer greater than or equal to 3, an upper end face and a lower end face of the prefabricated wall are formed with m mechanical connecting parts at the same axis position of the vertical ribs, m is an integer less than or equal to 2n, and the mechanical connecting parts are all formed at end heads of the vertical ribs, wherein each of the mechanical connecting parts comprises a bearing and connecting end, the end head of each vertical rib forms a bearing and connecting part protruding from a vertical end face of the concrete main body as the bearing and connecting end, an external thread is provided on the bearing and connecting end; and an outer diameter of the bearing and connecting end is 0.7~2 times an outer diameter of the vertical rib, wherein the mechanical connecting part comprises a bearing and connecting cavity, the end head of the vertical rib forms an open bearing part which is recessed inwards along an axial direction of the vertical rib as the bearing and connecting cavity, an internal thread is provided on the bearing and connecting cavity; an outer diameter of the bearing and connecting cavity is 1.2~3 times the outer diameter of the vertical rib, wherein the fastening component comprises a plug rod, a locking piece, a buckle barrel and an adapter sleeve;

the mechanical connecting part of the upper wall is correspondingly connected with the adapter sleeve, and the mechanical connecting part of the lower wall is correspondingly connected with the plug rod; or, the mechanical connecting part of the upper wall is correspondingly connected with the plug rod, and the mechanical connecting part of the lower wall is correspondingly connected with the adapter sleeve;

the buckle barrel is fixed in the adapter sleeve, the plug rod is inserted into the buckle barrel, and the locking piece is sleeved on the outer edge of the plug rod, so that the plug rod is clamped with the buckle barrel without a gap.

2. The assembly structure according to claim 1, further comprising a concrete cast-in-place area between the upper wall and the lower wall, wherein the concrete cast-in-place area covers the fastening component.

3. The assembly structure according to claim 1, further comprising a prefabricated floor slab, wherein a lower edge of the prefabricated floor slab rests on two adjacent lower walls.

4. The assembly structure according to claim 3, wherein a rigid truss is exposed on an upper surface of the prefabricated floor slab.

5. The assembly structure according to claim 3, further comprising a cast-in-place layer, wherein the cast-in-place layer is laid on the prefabricated floor slab and fills an assembly gap between the prefabricated floor slab, the upper wall and the lower wall.

6. The assembly structure of the assembled building according to claim 1, wherein the bearing and connecting cavity is formed based on a sleeve rigidly connected to the end head of the vertical rib, and an end of the sleeve far away from the vertical rib forms an open bearing and connecting cavity.

* * * * *